United States Patent [19]

Drury

[11] 4,106,079

[45] Aug. 8, 1978

[54] ILLUMINATED DRUM STICK, BATON

[75] Inventor: Lynn F. Drury, Stroud, Okla.

[73] Assignee: John Eaton Wilkinson, Oklahoma City, Okla.

[21] Appl. No.: 761,851

[22] Filed: Jan. 24, 1977

[51] Int. Cl.[2] ..... F21K 2/00

[52] U.S. Cl. ..... 362/34; 362/84; 362/102

[58] Field of Search ..... 240/2.25, 6.4 R, 6.65; 362/34, 84, 102

[56] References Cited

U.S. PATENT DOCUMENTS

| | | | |
|---|---|---|---|
| 3,576,987 | 5/1971 | Voight et al. | 240/2.25 |
| 3,917,264 | 11/1975 | Davidson et al. | 240/2.25 |

*Primary Examiner*—Stephen J. Lechert, Jr.

*Attorney, Agent, or Firm*—Head, Johnson & Chafin

[57] ABSTRACT

A drum stick, baton, or the like, constructed of a suitable transparent material and having an internal chamber for receiving a suitable chemiluminescent material therein whereby the drum stick, baton, or the like, may be selectively illuminated for display purposes.

8 Claims, 6 Drawing Figures

ILLUMINATED DRUM STICK, BATON

BACKGROUND OF THE INVENTION

1. Field of the Invention

This invention relates to improvements in drum sticks, batons, and the like, and more particularly, but not by way of limitation, to drum sticks, batons and the like which may be selectively illuminated for display purposes.

2. Description of the Prior Art

Many musical groups of today, such as marching bands, dance bands, and the like, present musical interludes for viewing by multitudes of people, such as during the half-time activities of an athletic contest, during a "pop" music concert, or the like. Much demand is being placed on these bands for producing more and more spectacular events, and it becomes increasingly difficult for relatively small bands having reduced financial allowances to meet these high performance expectations. As a result, many of these smaller groups of musicians, particularly those representing relatively small schools cannot participate in the manner in which the individual members of the group would like to participate.

SUMMARY OF THE INVENTION

The present invention contemplates a novel drum stick, baton, or the like, which may be selectively illuminated for producing a stunning effect during a musical performance, particularly when the lighting in the surrounding area is limited. The novel drum stick or the like is constructed of a suitable transparent material, such as a plastic material, and is separable to provide access to an interior chamber in the drum stick for receiving a suitable chemiluminescent material therein in order that the entire drum stick may be selectively illuminated. When the drum stick or the like is to be utilized in the normal manner and there is no need or desire for fanciful display purposes, the interior chamber may be empty, and the drum stick will not be illuminated. When it is desired to illuminate the drum stick, the stick may be separated for opening the interior chamber, and the chemiluminescent material may be deposited within the chamber, and the drum stick may be restored to a single unit status, and the entire drum stick will be illuminated by by the emitting of the lumination from the interior chamber through the transparent material from which the drum stick is constructed.

The chemiluminescent material may be of any suitable type, but is preferably the type utilized for night time flares, sometimes known as Cylalume Lightstick, and as shown in the Little et al U.S. Pat. No. 3,934,539. This usually comprises a sealed chamber having two chemical elements contained therein in separate compartments. When the capsule is bent transversely, the seal between the compartments is broken and the chemical elements are combined to create a luminous flare which gives off relatively great quantity of light. In the present invention, the capsule may be so bent prior to disposition thereof within the interior chamber of the drum stick, and the entire drum stick becomes illuminated. The effect is quite amazing and eye catching, and an impressive display may be produced from the group or band using the drum sticks.

Of course, the invention also contemplates the use of a conductor's baron, or the like, similarly constructed from a transparent plastic material and having a sectional construction providing access to an internal chamber which may selectively receive the chemiluminescent therein whereby the entire baton will be illuminated. This facilitates the leading of the band under limited lighting conditions in that the baton is readily visible from a relatively great distance. Still another embodiment of the invention contemplates a baton commonly known as a twirler's baton. This baton is of a similar transparent and hollow construction for selectively receiving the chemiluminescent material therein and provides a spectacular display, as for example, on a football field during the half-time activities with the stadium lights turned completely off or greatly dimmed. It is also anticipated that the upper rim of the drums of the band or other musical group may be constructed from a suitable transparent material and provided with an internal chamber therein accessible from the exterior thereof whereby the chemiluminescent material may be inserted into the chamber in order that the entire rim of the drum will be illuminated, thus adding to the exotic or somewhat breathtaking aspects of the overall display of the musical group.

DESCRIPTION OF THE PREFERRED EMBODIMENTS

Figure 1:
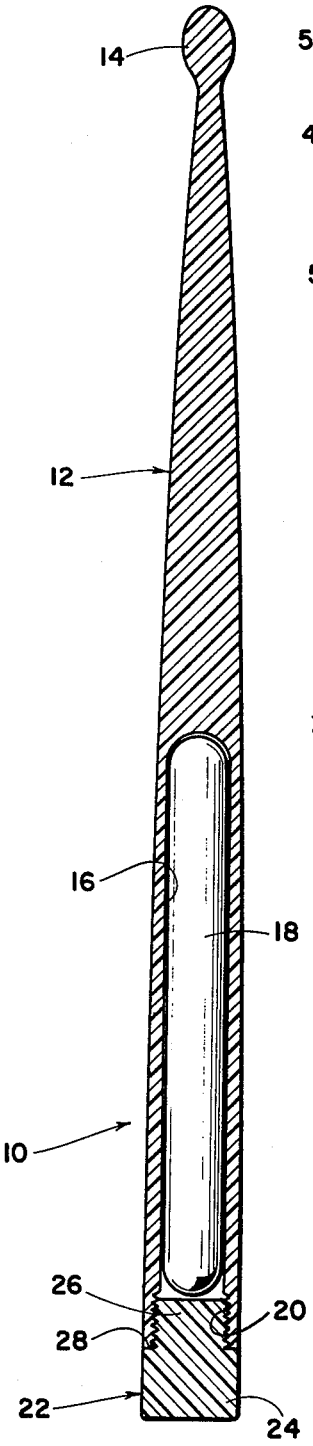
FIG. 1 is a sectional elevational view of a drum stick embodying the invention.
Figure 2:
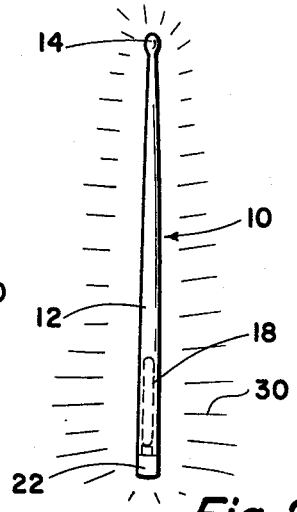
FIG. 2 is an elevational view of the drum stick shown in FIG. 1 and depicted on a reduced scale for purposes of illustration.

Referring to the drawings in detail, and particularly FIGS. 1 and 2, reference character 10 generally indicates a drum stick of the snare drum type which comprises a main body portion 12 constructed from a suitable transparent material, such as Lucite, which is a trademark of E. I. du Pont de Nemours & Co., Inc., and having the outer periphery thereof generally tapered in a longitudinal direction toward a head member 15 provided at one end of the body 12, as is well known. The opposite end of the body 12 is provided with a longitudinally extending centrally disposed chamber 16 for receiving a suitable capsule 18, or the like, therein for a purpose as will be hereinafter set forth. The outer end of the chamber 16 is preferably substantially circular in cross-sectional configuration and is threaded as shown at 20 for removably receiving an end cap 22 therein. The end cap 22 is preferably constructed from a transparent material, such as Lucite, and comprises a plug member 24 having an outer diameter substantially equal to the outer diameter of the larger end portion of the body 12. A reduced diameter stem plug 26 extends axially outwardly from one end of the plug member 24 providing an annular shoulder 28 for engagement with the outer end of the body 12 as particularly shown in FIG. 1. The outer periphery of the stem 26 is threaded for engagement with the bore 20 whereby the chamber 18 may be alternately closed and opened, as desired.

The capsule 18 may be of any suitable type containing a suitable chemiluminescent material, such as that disclosed in the aforementioned Little et al patent. For example, the capsule 18 may be so constructed for storing two chemicals (not shown) therein in separate sealed chambers (not shown). When the capsule 18 is manipulated in a suitable manner, such as by a transverse bending thereof, the seal between the two chambers is ruptured or otherwise opened for mingling of the two chemicals within the capsule. The chemicals thus mingled provide a relatively bright or strong illumination which emanates from the capsule for a substantially long time period, such as approximately three hours.

In the normal use of the drum stick 10, the end cap 22 is threadedly engaged with the bore 20 to close the chamber 16 and provide a substantially unitary or single structure. The drum stick 10 is preferably weighted in such a manner as to provide the optimum specification for the stick in order that the stick may be efficiently performing properly during the playing of the drum (not shown).

When it is desired to illuminate the drum stick 10 for enhancing the visual aspects of the performance of the user of the stick, the end cap 22 may be removed from the bore 20 by unthreading the stem 26 therefrom. A capsule 18 may then be manually grasped in the usual manner and bent in a transverse direction sufficiently for breaking the seal between the internal chambers thereof in order that the chemical elements stored therein are brought into contact with one another to illuminate the capsule. The capsule may then be inserted into the chamber 16, and the end cap 22 may be replaced in the bore 20 for sealing the capsule 18 within the chamber 16. The transparent material from which the body 12 and end cap 22 are constructed becomes illuminated by the glow from the capsule 18, and the entire drum stick 10 emits a relatively bright glow as indicated by the radiating lines 30 in FIG. 2. The glow is visible through a relatively great distance and produces a somewhat astounding effect as the stick 10 is utilized in the normal manner for performing on the drum (not shown).

Figure 3:
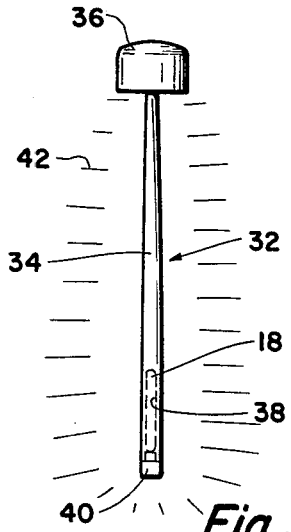
FIG. 3 is an elevational view of a modified drum stick embodying the invention.

Referring now to FIG. 3, a modified drum stick 32 is shown which is of the type commonly known as a bass drum, kettle drum, timpani, or the like. The stick 32 as shown herein comprises an elongated handle portion 34 constructed of a suitable transparent plastic material and having a relatively large head member 36 provided at one end thereof normally used for striking the drum (not shown) as is well known. The head 36 is preferably constructed of the usual material utilized in drum sticks of this type and thus may not be of a transparent construction. An internal chamber 38 is provided in the outer end of the handle 34 and extends longitudinally therein a sufficient distance for receiving the capsule 18 therein as hereinbefore set forth. A removable cap member 40 similar to the cap member 22 is secured to the outer end of the handle 34 in any suitable manner for alternately closing and opening the chamber 38 when the drum stick 32 is to be utilized in the normal manner for playing a drum (not shown). When it is desired to convert the drum stick 32 into an illuminated item, the end cap 40 may be removed from the handle 34 and the capsule 18 manipulated in the manner as hereinbefore set forth for producing an illumination, may be inserted into the chamber 38 and the end cap 40 may be replaced on the end of the handle 34. In this manner, the entire handle 34 and end cap 40 are illuminated, and a glow is transmitted thereform as indicated by the radiating lines 42 in FIG. 3. The drum stick 32 may then be utilized in the normal manner for performing on the drum.

Figure 4:
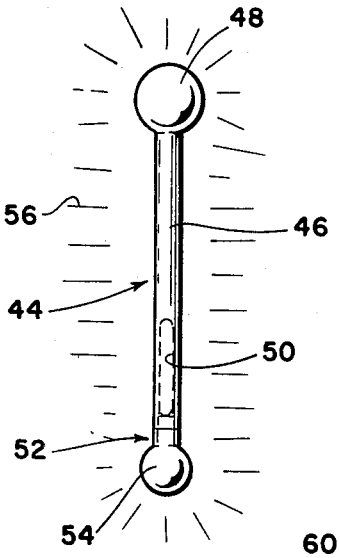
FIG. 4 is an elevational view of still another modified drum stick embodying the invention.

Referring now to FIG. 4, a modified drum stick 44 is shown which comprises an elongated staff member 46 having an enlarged substantially spherical member 48 provided at one end thereof preferably integral therewith, or rigidly secured thereto in any suitable manner (not shown), but not limited thereto. The outer end of the staff member 46 is provided with a substantially centrally disposed longitudinally extending chamber 50 therein for selectively receiving a capsule 18 as hereinbefore set forth. The chamber 50 is closed by an end plug member 52 which may be removably secured to the staff 46 in any suitable manner. The end plug 52 as shown herein is provided with a substantially spherical member 54 on the outer end thereof, preferably of a smaller diameter than the spherical member 48. The staff 46, spherical element 48, and the end plug 52 are preferably constructed from a suitable transparent plastic material, as hereinbefore set forth; and when the stick 44 is to be used in the normal manner, the end plug 52 is secured to the staff 46 for closing the chamber 50. When the stick 44 is to be utilized for illuminated display purposes, or the like, the end plug 52 may be removed from the staff 46, and the capsule 18, in the illuminating condition thereof, may be inserted into the chamber 50 and retained therein by replacing the end plug 52 in position on the staff 46. The entire stick 44 is thus illuminated and emits a glow as indicated by the radiating lines 56.

Figure 5:
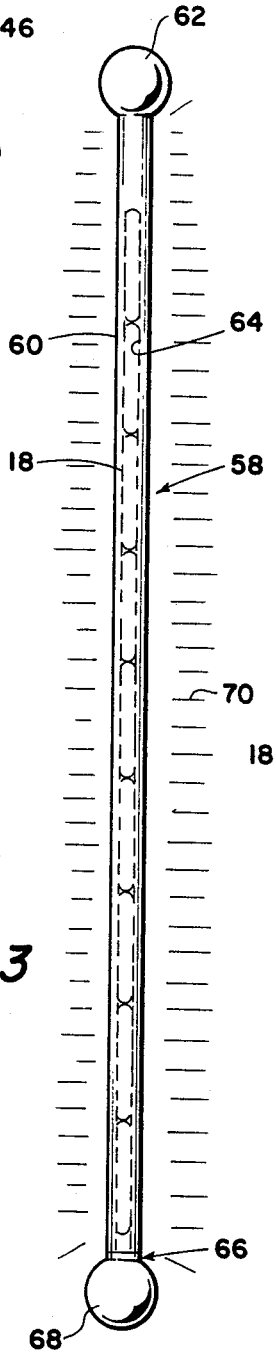
FIG. 5 is an elevational view of a twirler's baton embodying the invention.

A baton commonly known as a twirler's baton is generally indicated at 58 in FIG. 5 and comprises a relatively long tubular member 60 having a spherical element 62 provided at one end thereof, which is preferably integral with or rigidly secured thereto, but not limited thereto. The tubular member 60 is constructed from a suitable transparent material and is provided with a central passageway 64 extending substantially throughout the length thereof. The outer end of the passageway 64 is preferably open, and an end plug member 66 is removably secured to the tube 60 oppositely disposed from the spherical element 62 for alternately opening and closing the passageway 64. The end plug 66 preferably includes a spherical element 68 substantially identical with the spherical element 62; and when the end plug 66 is in position on the tubular member 60, the baton 58 is of a substantially unitary or singular assmebly and functions in the same manner as the usual twirler's baton. When it is desired to illuminate the baton 58, the end plug 66 may be removed from the tube 60, and a plurality of capsules 18 may be inserted in the passageway 64 in end-to-end relation. Of course, the capsules 18 are properly manipulated to combine the chemicals therein in such a manner as to produce an illumination as hereinbefore set forth. Thus, the entire length of the baton 58 is substantially brightly illuminated for emitting a strong glow as indicated by the radiating lines 70.

Figure 6:
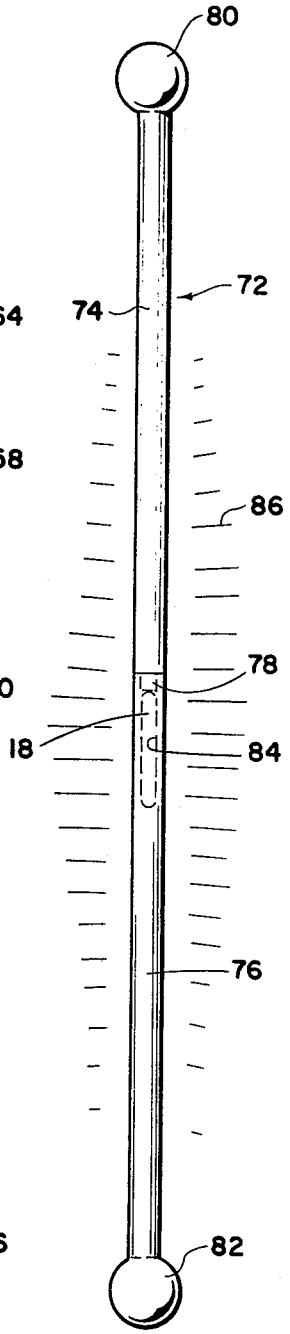
FIG. 6 is an elevational view of a modified baton embodying the invention.

A baton 72 is shown in FIG. 6 which is generally similar to the baton 58 and comprises a first elongated staff member 74 removably secured to a second elongated staff member 76 in any suitable manner, such as a pin and socket connection indicated at 78. The staffs 74 and 76 are constructed from a suitable transparent material and are each provided with a substantially spherical member 80 and 82, respectively, on the outer end thereof, as is well known. The inwardly directed end of one of the rods or elongated members, such as the element 76, is provided with a centrally disposed recess or chamber 84 extending longitudinally therein through a sufficient distance for receiving the capsule 18 therein, as hereinbefore set forth. When the baton 72 is to be utilized in the normal manner, the rods 74 and 76 are secured together in end-to-end relation as shown in FIG. 6, and the baton may be utilized in the well-known manner. When it is desired to provide an illuminated baton 72, the elements 74 and 76 may be separated for providing access to the chamber 84, and the activated capsule 18 may be inserted into the chamber 84 as hereinbefore set forth. The rods 74 and 76 may then be secured together, and substantially the entire length of the baton 72 will emit a glow therefrom as indicated by radiating lines 86. Of course, in this embodiment of the invention, it may be found that the illumination emitting from the central portion of the baton 72 will be brighter or greater than the illumination emitting from the remote ends thereof.

From the foregoing, it will be apparent that the present invention provides a novel illuminated drum stick, baton, or the like, particularly designed and constructed for producing spectacular lighted displays for entertainment purposes, or the like. The novel drum stick, or baton, comprises an elongated main body portion constructed from a suitable transparent material, such as Lucite, and having an internal chamber therein accessible from the exterior thereof whereby a suitable chemiluminescent material may be selectively deposited in the chamber in order that the drum stick, baton, or the like, will emit a glow which is visible through an extended distance. The devices may be utilized in substantially any desired environment wherein a lighted display is desired, such as during half-time activities at a football game, or the like, or in a dance hall, or the like. The novel illuminated instrument is simple and efficient in construction and economical and durable in construction.

Whereas the present invention has been described in particular relation to the drawings attached hereto, it should be understood and other and further modifications. apart from those shown or suggested herein, may be made within the spirit and scope of this invention.

What is claimed is:

1. An article adapted to be selectively illuminated and comprising body means constructed from a suitable transparent material, internal chamber means provided in said body means and accessible from the exterior thereof for selectively receiving a suitable self-contained chemiluminescent capsule therein whereby said body may be manipulated for selectively activating said capsule for emitting lumination from the body.

2. An article as set forth in claim 1 wherein said body means comprises a sectional body having the internal chamber means in one section thereof, and the other section thereof is removably secured to said first section for alternately opening and closing said chamber to provide said access thereto for facilitating insertion and withdrawal of said capsule from said chamber.

3. An article as set forth in claim 1 wherein said body means comprises a first element having a configuration generally similar to a snare drum stick, having a head member provided at one end thereof, said internal chamber means being provided in said first element and open at the end thereof opposite the head member for selectively receiving the self-contained chemiluminescent capsule therein, and end cap means removably secured to said opposite end for alternately opening and closing said chamber means.

4. An article as set forth in claim 1 wherein said body means comprises a first element having a configuration generally similar to a bass drum stick and having a head member provided at one end thereof, said internal chamber means being provided in said first element and extending longitudinally therein, said internal chamber being open at the end of the first element oppositely disposed with respect to the head member, and end cap means removably secured on said open end for alternately opening and closing said chamber means.

5. An article as set forth in claim 1 wherein said body means comprises an elongated tubular member having a centrally disposed internal passageway extending substantially throughout the length thereof for providing said chamber means, said passageway being open at one end thereof for providing access thereto, and end plug means removably secured to said open end for alternately opening and closing said passageway.

6. An article as set forth in claim 5 wherein substantially spherical head means is provided at one end of both the elongated tubular member and the end plug means.

7. An article as set forth in claim 1 wherein said body means comprises at least two elongated rod members removably secured together in end-to-end relation, said chamber means being provided in one of said rod members in the end thereof adjacent the other of said rod members whereby said rod members may be separated to provide access to said chamber means.

8. An article as set forth in claim 7 wherein the outer end of each of said rod members is provided with a substantially spherical head member.

* * * * *